United States Patent [19]

Dey

[11] 4,038,542

[45] July 26, 1977

[54] LUMINAIRE FOR CONTROLLING LOCALLY UNIDIRECTIONAL LIGHT

[75] Inventor: Thomas W. Dey, Rochester, N.Y.

[73] Assignee: Bausch & Lomb Incorporated, Rochester, N.Y.

[21] Appl. No.: 597,846

[22] Filed: July 21, 1975

[51] Int. Cl.[2] ..... F21V 13/00

[52] U.S. Cl. ..... 240/92; 240/41.3; 240/41.35 C; 240/103 R; 240/106.1

[58] Field of Search ..... 240/41.3, 41.35 C, 41.37, 240/41.4 R, 92, 93, 103 R, 103 B, 106 R, 106.1

[56] References Cited

U.S. PATENT DOCUMENTS

| | | | |
|---|---|---|---|
| 3,064,125 | 11/1962 | Gott | 240/106.1 |
| 3,234,376 | 2/1966 | Ceglia | 240/106 R |
| 3,283,142 | 11/1966 | Freeman | 240/46.41 |
| 3,835,342 | 9/1974 | Freeman | 240/41.35 C |

*Primary Examiner*—Russell E. Adams

*Attorney, Agent, or Firm*—Frank C. Parker; Bernard D. Bogdon

[57] ABSTRACT

A luminaire having an aperture provides first and second zonal illumination areas. A reflector is disposed about a light source for reflecting a first portion of light emitted from the light source through a first zone of the aperture. A deviator is disposed within the reflector for permitting passage of the first portion of light and for directing a second portion of light emitted from the light source through a second zone of the aperture.

5 Claims, 5 Drawing Figures

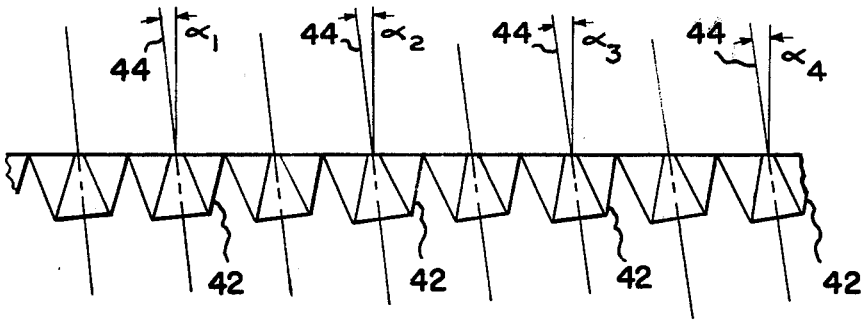
FIG. 2
FIG. 4
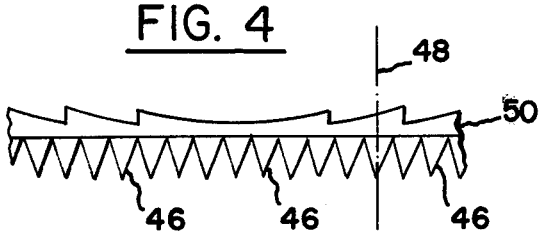
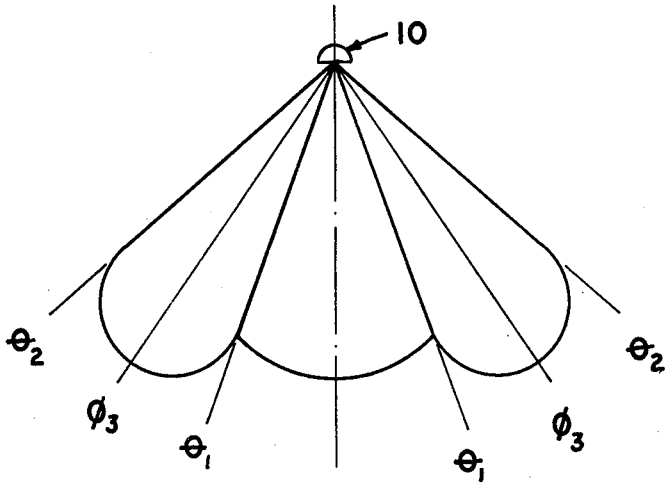
FIG. 5

LUMINAIRE FOR CONTROLLING LOCALLY UNIDIRECTIONAL LIGHT

BACKGROUND AND SUMMARY OF THE INVENTION

Rapid advances are being made in the lighting industry for improving the lighting efficiency of luminaires. At least two suggested improvements are useable with substantially collimated light. One of these improvements involves a luminaire which radially polarizes the substantially collimated light. The radially polarized light is used to diminish the veiling reflections from a task surface. Another of these improvements involves a lighting panel for controlling the distribution of light passing through the panel. The light passing through the panel is controlled by using a plurality of light modifying elements for critically reflecting and then refracting such light.

It is common practice within the industry to provide substantially collimated light by disposing a lamp within a parabolic reflector. The reflector is sufficiently large so as to make the lamp appear as a "point source". The light rays that are reflected from the reflector are substantially collimated. However, the direct light rays from the lamp through the luminaire's aperture are not substantially collimated. Some solutions that have been attempted to compensate for these direct rays are the use of caps to mask out these rays and reflectors within the luminaire to return these rays past the light source to the parabolic reflector. These solutions, however, adversely effect the lighting efficiency of such luminaires.

The improved luminaire having an aperture of this invention uses substantially all the light emitted from a light source. A reflector is disposed about a light source and reflects a first portion of light emitted from the light source through a first zone of the aperture to provide a first zonal illumination area. A deviator means is disposed within the reflector for directing a second portion of light different than the first portion of light, emitted from the light source through a second zonal illumination area. Thus, locally unidirectional light is provided across the luminaire aperture since the deviator prevents the direct passage of light rays from the light source through illumination points in the first illumination zone which receive reflected light from the surface of a reflector which is shaped and constructed according to the principles of the present invention.

Further, the improved luminaire may include a light modifying means disposed at least across the first zone of the aperture for controlling light passing through the first zone. This light modifying means is designed to control the distribution of light within a control range. The control is accomplished by using a plurality of light modifying elements with each element designed for critically reflecting the passing light and then refracting such light.

BRIEF DESCRIPTION OF THE DRAWINGS

Objects and advantages of the invention will become apparent upon reading the following description and upon reference to the drawings, in which like reference numerals refer to like elements in the various views:

FIG. 2 is an enlarged elevational view taken at the circle indicated by II in FIG. 1.

FIG. 4 is an enlarged elevational view of an alternate embodiment taken at the circle indicated by II in FIG. 1.

FIG. 5 is an elevational view of the embodiment of the present invention illustrated in FIGS. 1 and 4 and showing an idealized radial distribution of light.

DETAILED DESCRIPTION OF THE PREFERRED EMBODIMENTS

Figure 1:
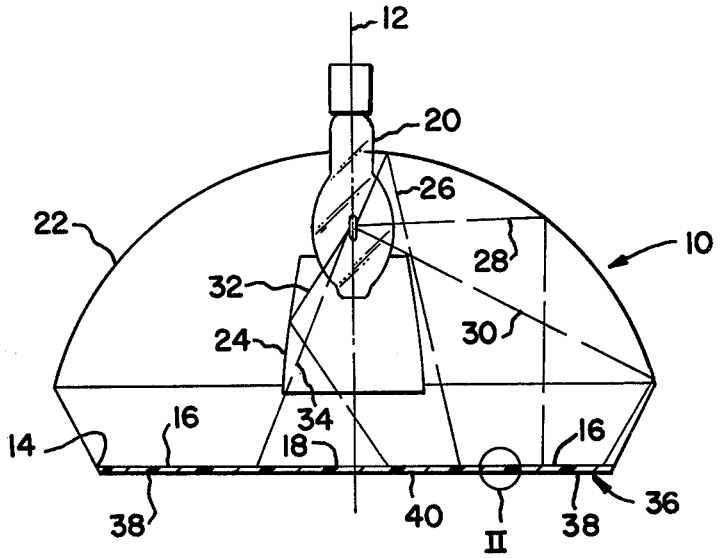
FIG. 1 is a sectional, elevational view of an embodiment of the present invention.

As best seen in FIG. 1, a luminaire 10 has an axis of symmetry 12 and an aperture 14, which is divided into at least a first aperture zone 16 and a second aperture zone 18. Luminaire 10 uses a light source 20 disposed along axis 12, a concave symmetrical reflector means 22 disposed about light source 20 and a deviator means 24 symmetrically disposed about axis 12 within reflector means 22.

Deviator means 24 is designed and positioned within reflector means 22 for preventing the direct passage of light from light source 20 through first aperture zone 16 and for permitting the direct passage of light from light source 20 through second aperture zone 18. A first portion of light represented by rays 26, 28 and 30, illustrate light emitted from light source 20, being reflected from reflector means 22, passing through first aperture zone 16 as locally unidirectional light and providing a first zonal illumination area. A second portion of light, represented by light rays 32 and 34, illustrate light emitted by light source 20, passing through second aperture zone 18 and providing a second zonal illumination area. It is preferred to use a second reflector means in deviator means 24, so that substantially all of the light emitted by light source 20 is permitted to pass through aperture 14.

It is preferred, when practicing the invention, to design reflector means 22 to provide uniform lighting flux across first aperture zone 16. For a given light source 20 and size and location of aperture 14 the design is numerically derived by Snell's law of reflection, certain photometric definitions and selected boundary conditions. The given light source 20 is determined by its candlepower distribution with the distribution of a high intensity discharge lamp being preferred. The size of aperture 14 can be varied, while the location of aperture 14 is preferably extending symmetrically and transversely to axis 12. Snell's law of reflection is well known in the art. The photometric definitions explain how luminous flux is propagated and the selected boundary condition involves using the uppermost point of reflector means 22 to reflect a light ray to the innermost point of first aperture zone 16, illustrated by light ray 26, and using the lowermost point of reflector means 22 to reflect a light ray to the outermost point of first aperture zone 16, illustrated by light ray 30.

Figure 3:
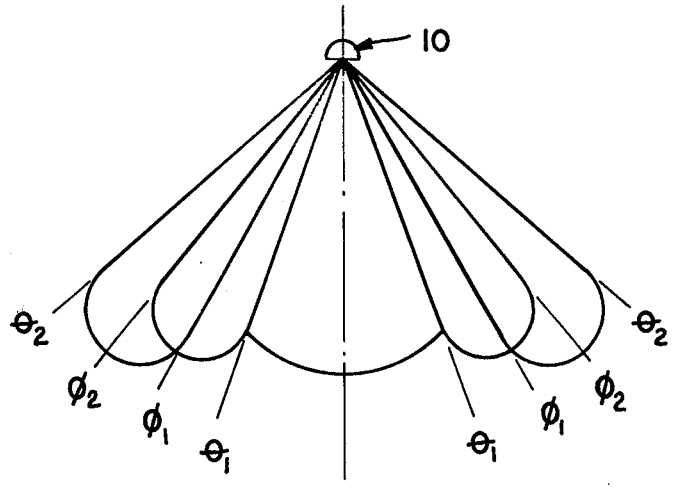
FIG. 3 is an elevational view of the embodiment of the present invention illustrated in FIGS. 1 and 2 and showing an idealized radial distribution of light.

In certain situations, the distribution of all or some of the light passing through aperture 14 should be controlled within a control range. Preferably, the locally unidirectional light passing through first aperture zone 16 is controlled between $\theta_1$ and $\theta_2$ by critically reflecting and then refracting such light. To accomplish this control, a light modifying means 36 is disposed across aperture 14 and has a first zone 38 substantially corresponding to first aperture zone 16 and a second zone 40 substantially corresponding to second aperture zone 18. As the locally unidirectional light passes through first zone 38, the passing light may be controlled by light modifying elements 42 having an axis of symmetry 44, FIG. 2, or by light modifying elements 46 having an axis of symmetry 48, FIG. 4. Light modifying elements 42 critically reflect and then refract the locally unidirectional rays of light to provide a radial light distribution of two peak intensities, $\phi_1$ and $\phi_2$, within the control range, $\theta_1$ and $\theta_2$, as illustrated in FIG. 3. Light modifying elements 46 critically reflect and then refract the locally unidirectional light rays to provide a radial light distribution of a single peak intensity, $\phi_3$ within the control range, $\theta_1$ and $\theta_2$, as illustrated in FIG. 5.

To obtain proper control of the light distribution within the control range, light modifying elements 42 or 46 must be properly oriented with respect to the incoming light. This orientation may be accomplished in at least two ways. One way is to direct the base of each element 42 or 46 generally toward the locally unidirectional light, thereby forming an angle $\alpha$ between the axis of symmetry of each element 42 or 46 and a normal to light modifying means 36, as illustrated by angles $\alpha_1$, $\alpha_2$, $\alpha_3$ and $\alpha_4$ in FIG. 2. The size of these angles depend on the angles of the incoming unidirectional light rays and can be determined by ray traces from light source 20 to reflector means 22 and then to first aperture zone 16. A second way to orient light modifying elements 42 and 46 relative to the incoming light involves converting the locally unidirectional light into substantially collimated light. This conversion is accomplished by locating a Fresnel lens 50 across first aperture zone 16 above light modifying means 36. Fresnel lens 50 is designed by using conventional techniques and ray traces from light source 20 to reflector 22 and then to first aperture zone 16. Axis of symmetry 44 and 48 for light modifying elements 42 and 46, respectively, are positioned to be substantially parallel to the substantially collimated light, as illustrated in FIG. 4. By such orientation of light modifying elements 42 and 46, light passing through light modifying means 36 is controlled within the desired control range by critically reflecting and then refracting such light.

What is claimed is:

1. A luminaire having an aperture for providing locally unidirectional light across a zone of the aperture, comprising:

a light source for emitting visible light;

reflector means for reflecting a portion of light emitted from said light source through a first zone of the aperture to provide a first zonal illumination area and for providing light of substantially uniform flux across the first zone;

deviator means disposed within said reflector means for preventing the direct passage of light from said light source to the first zone and for directing a second portion of light emitted from said light source through a second zone of the aperture to provide a second zonal illumination area, the deviator and reflector means being constructed to provide substantially equal zonal illumination of the first and second areas; and light modifying means disposed across the aperture for controlling the locally unidirectional light passing through at least the first zone by critically reflecting and then refracting such light into a control range.

2. The luminaire of claim 1, wherein said light modifying means includes a plurality of light modifying elements for controlling the locally unidirectional light, each element having a base with the base of each element generally facing the locally unidirectional light.

3. A luminaire having an aperture for providing locally unidirectional light across a zone of the aperture, comprising:

a light source for emitting light;

reflector means for reflecting a portion of light emitted from said light source through a first zone of the aperture to provide a first zonal illumination area;

deviator means disposed within said reflector means for preventing the direct passage of light from said light source to the first zone and for permitting the passage of a second portion of light through a second zone of the aperture to provide a second illumination area; and light modifying means disposed across at least the first zone of the aperture for controlling the locally unidirectional light passing through the first zone of the aperture by critically reflecting and then refracting such light into a control range.

4. The luminaire of claim 3, wherein said light modifying means includes a plurality of light modifying elements for controlling the locally unidirectional light, each element having a base with the base of each element generally facing the locally unidirectional light.

5. A luminaire having an aperture for providing locally unidirectional light across a zone of the aperture, comprising:

a light source for emitting light;

reflector means for reflecting a portion of light emitted from said light source through a first zone of the aperture to provide a first zonal illumination area;

deviator means disposed within said reflector means for preventing the direct passage of light from said light source to the first zone and for permitting the passage of a second portion of light through a second zone of the aperture to provide a second illumination area; and light modifying means disposed across at least the first zone of the aperture for controlling the locally unidirectional light passing through the first zone of the aperture by critically reflecting and then refracting such light into a control range, including a plurality of light modifying elements, a corrector plate means in juxtaposition with said light modifying elements for refracting the substantially unidirectional light into substantially collimated light, and each element of said light modifying means having a base with the base of each element generally facing the substantially collimated light.

* * * * *